United States Patent [19]

Ehrenfels et al.

[11] 4,381,879

[45] May 3, 1983

[54] DETENTING LIFT COVER

[75] Inventors: Alfred L. Ehrenfels, Cheshire; Michael R. Marks, Trumbull, both of Conn.

[73] Assignee: Harvey Hubbell Incorporated, Orange, Conn.

[21] Appl. No.: 237,889

[22] Filed: Feb. 25, 1981

[51] Int. Cl.[3] ..... H01R 13/44

[52] U.S. Cl. ..... 339/44 R; 174/67; 220/291; 220/292

[58] Field of Search ..... 339/36, 44 R, 44 M; 174/67; 220/242, 291, 292

[56] References Cited

U.S. PATENT DOCUMENTS

| | | | |
|---|---|---|---|
| 15,181 | 6/1856 | Hawkins et al. | 74/2 |
| 1,334,172 | 3/1920 | Ryerson | 174/67 |
| 1,565,645 | 12/1925 | Hills | 114/178 |
| 1,912,277 | 5/1933 | Kaye | 220/291 |
| 2,072,608 | 3/1937 | Smith | 89/17 |
| 2,425,846 | 8/1947 | Trewren | 114/178 |
| 2,452,922 | 11/1948 | Gonsett et al. | 174/67 |
| 2,715,212 | 8/1955 | Swanson et al. | 339/44 M |
| 3,140,344 | 7/1964 | Slater et al. | 174/67 |
| 3,950,055 | 4/1976 | Samuels et al. | 339/44 R |
| 4,342,493 | 8/1982 | Grenell | 339/44 M |

FOREIGN PATENT DOCUMENTS

| | | | |
|---|---|---|---|
| 1540150 | 5/1970 | Fed. Rep. of Germany | 339/44 R |
| 549642 | 11/1922 | France . | |
| 1148418 | 6/1957 | France . | |
| 1148418 | 6/1958 | France | 339/44 R |
| 521132 | 11/1938 | United Kingdom . | |
| 533590 | 2/1941 | United Kingdom | 220/291 |

*Primary Examiner*—John McQuade
*Assistant Examiner*—Gary F. Paumen
*Attorney, Agent, or Firm*—Jerry M. Presson

[57] ABSTRACT

A weatherproof housing and rotatable cover have radial lugs which are engaged when the cover is closed in a specific position and rotated clockwise. The cover is hingedly attached to the housing by a J-shaped arm and the cover has a skirt, one surface of which faces walls formed on the arm. The skirt has cam and stop surfaces defining a recess which engages a wall on the arm in the specific position, acting as a detent to inhibit rotational movement of the cover when it is open. Limited tilting movement of the cover is permitted by a sinuous spring in the mounting of the cover on the arm. A stop pin on the skirt prevents the cover from being rotated by 180°.

11 Claims, 4 Drawing Figures

DETENTING LIFT COVER

This invention relates to an improved housing for an electrical connector and particularly to a cover structure for weatherproof housing.

BACKGROUND OF THE INVENTION

It is well knwon to provide a housing for a wiring device or electrical connector which is to be used in an area exposed to weather wherein the housing has a pivotable or removable cover which, when closed, protects the electrical components in the housing from the weather but which can be opened for ready access to those electrical components.

Some such devices have hinged covers which are spring-urged toward a closed position so that they will remain open only while being manually held open or so held by a mating connector or similar device extending into the housing.

In addition, the cover and mouth of the housing can be provided with mating threads or cam surfaces so that the closed cover can be rotated to complete the weather seal.

If, when the cover is open, it is rotated to a position in which the cam surfaces or threads are not aligned to the proper position for commencing engagement, it is sometimes difficult to located the proper angular position from which the cover cam can be rotated into the fully locked condition. This is particularly true with cam surfaces which are normally not symmetrical. In an industrial or commercial environment, this commonly means that the worker who is supposed to close the cover becomes confused and does not rotate it into the locked position, thus failing to fully seal the structure into its weather-tight condition and partially defeating the purpose of the housing.

In addition, if the cover is rotated away from the proper position while open and is then allowed to snap shut by the spring force, the cams or threads can be damaged.

Following are several references which show housings and closures for electrical equipment and also rotatable closures from unrelated technical areas as examples of prior art structures related to the present invention.

| | | |
|---|---|---|
| U.S. Pat. No. | 15,181 | Hawkins |
| U.S. Pat. No. | 1,334,172 | Ryerson |
| U.S. Pat. No. | 1,565,645 | Hills |
| U.S. Pat. No. | 1,912,277 | Kaye |
| U.S. Pat. No. | 2,072,608 | Smith |
| U.S. Pat. No. | 2,425,846 | Trewren |
| U.S. Pat. No. | 2,452,922 | Gonsett et al. |
| U.S. Pat. No. | 3,140,344 | Slater et al. |
| U.S. Pat. No. | 3,950,055 | Samuels et al. |
| French Patent | 1,148,418 | Hainault |
| French Patent | 549,642 | Granat |
| British Patent | 521,132 | Graviner Mfg., Co. Ltd. |

The patents to Hawkins, Hills, Kaye, Smith and Trewren are examples of closures for gun breeches, port lights and other structures, some of which have threads or cam surfaces but which do not deal with the foregoing problems.

The French patent to Hainault, the British patent to Graviner Mfg., Co., Ltd., and the U.S. patents to Ryerson, Gonsett et al., Slater et al. and Samuels et al. show covers for electrical wiring devices which are either spring urged toward a closed position, are rotatable or are locked closed by separate means, but which do not treat the problem of rotation while open.

The French patent to Granat shows a rotatable cover for an electrical connector which is spring urged toward its closed position and which is rotatable to cause engagement of cams on the housing and cover to lock the cover closed. In addition Granat provides a ball detent on the hub of the cover to keep the cover properly positioned while open.

However, this structure has the disadvantage that it can easily be defeated by simply bumping the knob.

BRIEF DESCRIPTION OF THE INVENTION

An object of the present invention is to provide a housing having a cover rotatably mounted on an arm which is hingedly attached to the housing, the cover having a skirt portion at least partially surrounding the end of the housing and locking means engaged by rotation of the cover, and a position detent on the cover in its unlocked rotational position when the cover is open.

Briefly described, the invention includes an improved combination housing and cover assembly of the type including a generally cylindrical housing having an open end, a generally cylindrical cover for closing the open end and an arm hingedly mounted on the outside of the housing and extending to the center of the cover, means for rotatably mounting the cover on the arm, and interengageable means on said housing and said cover for securing said cover to said housing upon rotation of said cover through a predetermined angle from a first position to a second position, wherein the improvement comprises a wall formed on said arm and extending toward and closely adjacent to said cover; means on said cover for defining, in sequence, a sloping cam surface, a recess dimensioned to receive said wall and a protruding stop shoulder, said recess being angularly located on said cover to receive said wall and inhibit cover rotation when said cover is in said first position in which said means for securing is disengaged, whereby said cover and arm can be hinged away from said open end with said wall in said recess, said cover being rotatable to said second position when said cover is closed by rotating said cover so that said cam surface rides over said wall.

In order that the manner in which the foregoing and other objects are attained in accordance with the invention can be understood in detail, a particularly advantageous embodiment thereof will be described with reference to the accompanying drawings, which form a part of this specification, and wherein.

Figure 1:
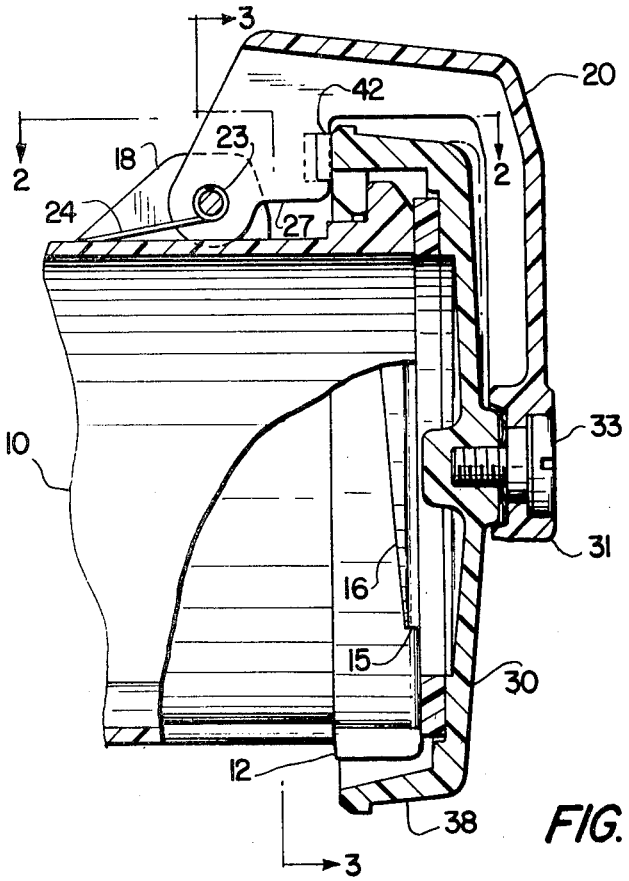
FIG. 1 is a partial side elevation, in section, of a housing and cover in accordance with the present invention.
Figure 3:
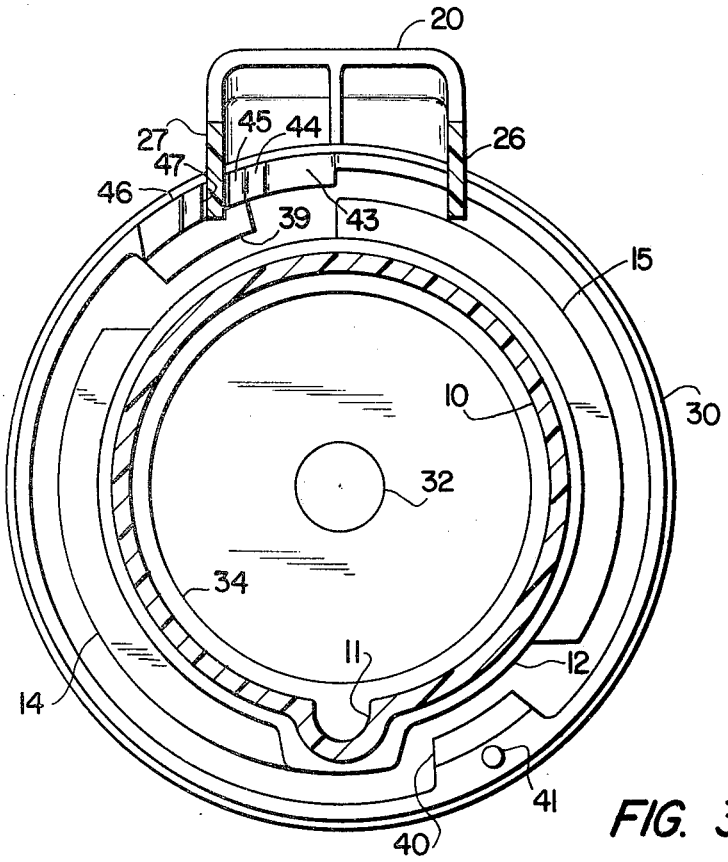
FIG. 3 is a transverse sectional view along line 3—3 of FIG. 1.

As shown in FIG. 1 and 3, the apparatus includes a generally cylindrical housing 10 designed and dimensioned to receive one-half of an electrical connector or some other form of wiring device which is to be accessible but protected from weather. The specific housing shown has an axially extending groove 11 for orienting a connector therein. Near the mouth of the housing the wall thereof is thickened at 12 and directly adjacent the mouth are two circularly extending, radially protruding flanges 14 and 15. Each of flanges 14 and 15 occupies about 120° of arc, and the flanges are diametrically opposite each other, leaving gaps of about 50° and 35° on opposite sides of the housing mouth.

Each flange 14, 15 has a surface facing axially away from the open end of the housing, which surface is inclined relative to the housing axis as illustrated at 16, thereby forming a cam surface on each flange similar to a portion of a screw thread but being generally planar rather than being helical. It will be observed that the sum of the angles mentioned above totals 325°, the remaining 35° of the circle being occupied by the thick portion of the housing mouth radially outwardly of groove 11, and by bevels and clearance gaps at the ends of the flanges.

Fixedly attached to the outside of the housing 10 are two lugs 17 and 18 (FIG. 2) which extend outwardly in parallel, spaced relationship from the outer surface of the housing, these lugs being provided with coaxially aligned openings to receive the ends of an axial pin 19. An arm 20 is mounted for pivotal movement about the axis of axle 19, the arm being generally J-shaped in side elevation and the longer leg and bottom portion of the J being U-shaped in cross-section.

Figure 4:
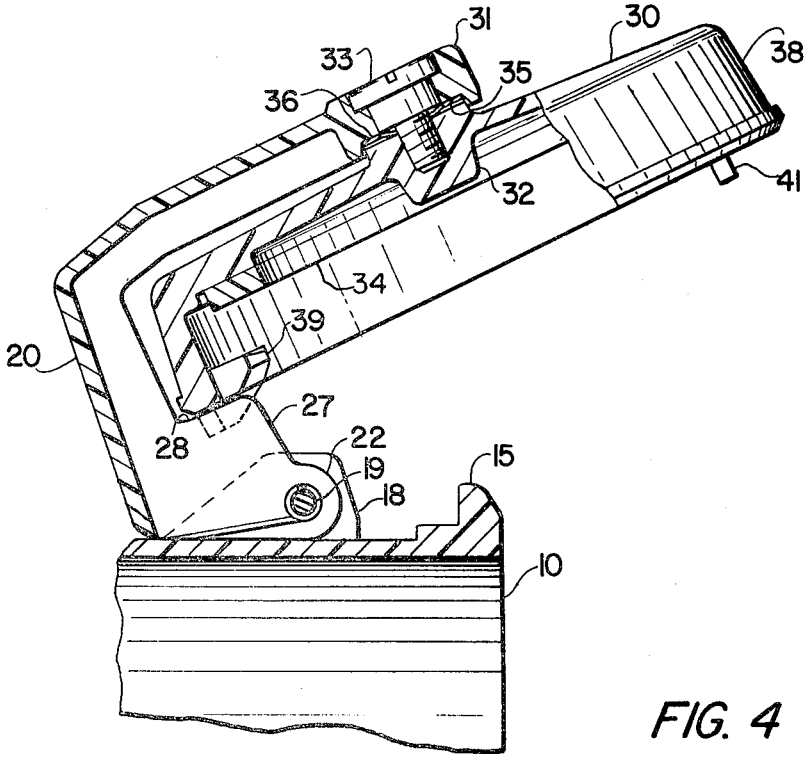
FIG. 4 is a side elevation in partial section of the structure of FIGS. 1–3 with the cover in its open position.

The ends of the walls forming the short leg of the J are provided with thickened bosses 21 and 22, pierced by openings to receive axle 19, the bosses being spaced apart by a distance smaller than lugs 17 and 18 so that the bosses lie between the lugs. A torsion coil spring 23 surrounds axle 19, one end 24 of the spring 23 bearing against the body of the housing 10 and the other end 25, in the embodiment shown, being bent to enter a small hole in the arm so that the spring urges the arm toward its closed position, i.e., clockwise as seen in FIGS. 1 and 4. In larger units, where a larger spring involving more force is used, a tap or shelf protruding from wall 26 of arm 20 can be provided to engage the end of 25 of the spring.

The walls 26, 27 forming the short leg of the J are substantially identical in shape in side elevation in the embodiment shown, at least wall 27 including a surface 28 which faces toward a generally circular, cup-shaped cover 30. The distal end of the arm 20 is provided with a boss 31 to which the center of the cover is rotatably connected. The cover includes a thickened central body 32 which has an internally threaded, axially extending opening to receive the externally threaded end of a screw 33 passing through boss 31. It will be observed that screw 33 has an enlarged head portion which abuts a shoulder in the opening in boss 31 to limit its penetration into boss 31. It will also be observed that boss 31 has, on its inner side facing the cover, an annular recess 35 which receives a spring 36 lying between that recess and the outer annular surface of thickened body 32 of the cover. Spring 36 is circular in plan view and is sinuous in side elevation, thereby acting as a compression spring, tending to urge the cover 30 away from boss 31 and holding screw 33 firmly in its seated position. The spring is normally not fully compressed, thereby permitting limited tilted movement of the cover relative to boss 31 and arm 20.

Within cover 30 is a sealing ring 34 which, in the embodiment shown in FIGS. 1, 3 and 4, is bonded to the inner surface of cover 30. Ring 34 is made of an elastomeric or polymeric material such as rubber or a synthetic substitute for rubber and is sufficiently compressible and resilient to form a good seal with the mouth of the housing.

The cover also includes an annular skirt portion 38 which is dimensioned to surround housing 10 and its flanges, the skirt having radially inwardly extending flanges 39 and 40, each of these flanges occupying approximately 20° of arc at their inner ends and tapering outwardly slightly to merge with the interior of skirt 38. A stop pin 41 protrudes axially from the skirt at approximately the center of flange 40. It will be observed that flanges 39 and 40 easily fit within the arcuate gaps between flanges 14 and 15 on housing 10.

Figure 2:
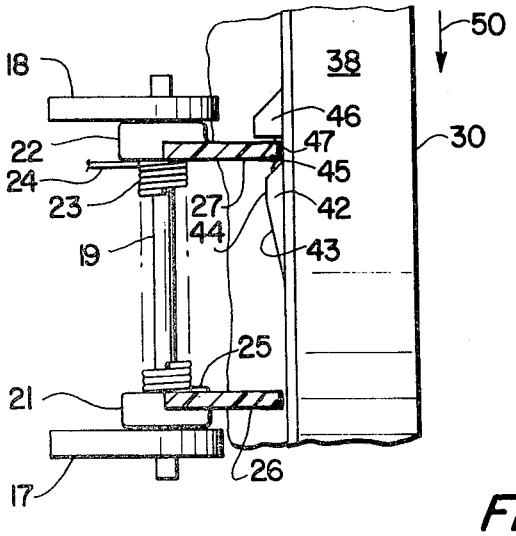
FIG. 2 is a partial top plan view, in partial section, along line 2—2 of FIG. 1.

Adjacent flange 39 on the axially facing surface of skirt 38 is a fixedly attached cam surface and stop structure which cooperates with shoulder 28 on wall 27 to form the detent structure of the present invention. As best seen in FIG. 2, this arrangement includes a cam member 42 which protrudes axially from the skirt and has a gently sloping surface 43, an intermediate portion 44 and a steeper slope 45, the angles of surfaces 43 and 45 being approximately 12° and 45° respectively, relative to the adjacent planar axially-facing surfaces of the skirt. Spaced from the termination of surface 45 by a distance greater than the thickness of wall 27 is a stop member 46 having a shoulder 47 protruding at right angles from the skirt in the axial direction, stop member 46 also having a sloping surface on the other side which is, for the most part, nonfunctional. Surfaces 45 and 47 define a recess dimensioned to receive wall 27, surface 47 constituting a stop shoulder to positively limit rotation of cover 30 in a counterclockwise direction, i.e., the direction indicated in FIG. 2 by the arrow 50.

As previously mentioned, the cover is shown in FIG. 1 in the "partially closed" position, meaning that the cover has not yet been rotated to engage flange 39 and 40 with flanges 15 and 14. Wall 27 lies, in that position, in the recess between surfaces 45 and 47 as shown in FIG. 2. To lock the cover closed, it is rotated counter to the direction of arrow 50, causing surface 45 to ride up over surface 28. As that happens, the cover tilts slightly as shown by a dash-dot lines in FIG. 1, this tilting action being permitted by the compression of one side of spring 35. As rotation is continued, surfaces 44 and 43, respectively, ride over surface 28 and the cover returns to its untilted position.

This tilting or "floating" action provided by spring 35 also permits the force of spring 19 to urge the cover into alignment with the body such that the elastomeric seal 34 fits tightly against the face of body 10. This sealing keeps out moisture and insect life even without engagement of the flanges.

When the cover is unlocked by reverse rotation, wall 27 returns to the gap between surfaces 45 and 47. When the cover is then fully open, as shown in FIG. 4, rotation is greatly inhibited by the wall resting in the gap, thereby keeping the cover in the proper position so that flanges 39 and 40 will fit in the gaps between flanges 14 and 15 when it is closed again.

It is, of course, possible to rotate the cover when it is fully open. However, the action of spring 35 keeps wall 27 in the gap quite firmly so that intentional effort is necessary to defeat the detent structure.

In the event that the cover is rotated while open, stop pin 41 reaches wall 26 and prevents the cover from being rotated 180°. Thus, the cover must be returned to the position in FIG. 4 before it can be closed and locked, preventing an attempt to interchange the lid flange positions.

While one advantageous embodiment has been chosen to illustrate the invention it will be understood by those skilled in the art that various changes and modifications can be made therein without departing from the scope of the invention as defined in the appended claims.

What is claimed is:

1. An improved combination housing and cover of the type including a generaly cylindrical housing having an open end and an arm hingedly mounted on the outside of the housing and extending to the center of the cover, means for rotatably mounting the cover on the arm, and interengageable means on said housing and said cover for securing said cover to said housing upon rotation of said cover through a predetermined angle from a first position to a second position, wherein the improvement comprises a wall formed on said arm and extending toward and closely adjacent to said cover;

means on said cover for defining, in sequence, a cam having a sloping cam surface, a recess dimensioned to receive said wall, and a protruding stop shoulder, said recess being angularly located on said cover to receive said wall and inhibit cover rotation when said cover is in said first position in which said means for securing is disengaged, whereby said cover and arm can be hinged away from said open end with said wall in said recess, said cover being rotatable to said second position when said cover is closed by rotating said cover so that said cam surface rides over said wall.

2. An assembly according to claim 1 wherein said means for rotatably mounting said cover on said arm includes a bushing formed on said arm;

an axle extending between said cover and said arm; and spring means between said cover and said bushing for urging said cover and arm away from each other and for permitting limiting tilting movement of said cover relative to said arm.

3. An assembly according to claim 2 wherein said spring means comprises a generally circular spring having a sinuous configuration in the axial direction.

4. An assembly according to claim 2 wherein said arm is generally J-shaped with the longer leg of the J having said means for mounting the cover, the shorter leg of the J being pivotally attached to said housing and the portion between the longer and shorter legs receiving the edge of the cover, said wall being formed on said shorter leg.

5. An assembly according to claim 4 wherein said cover includes a circular portion having a diameter greater than the outer diameter of the end of said housing and a generally axially extending skirt portion adapted to surround the end of said housing, said skirt portion having said means defining said cam surface, recess and stop shoulder on an axially facing surface thereof.

6. An assembly according to claim 5 and further including an annular elastomeric seal attached to the inner surface of said circular portion of said cover for contacting the end of said housing and forming a seal therewith when the cover is closed.

7. An assembly according to claim 4 wherein said housing includes first and second radially protruding generally parallel ears fixedly attached to the exterior of said housing, and an axle extending through said ears and said arm for hingedly supporting said arm.

8. An assembly according to claim 7 and including a spring mounted on said axle and acting between said housing and said arm for urging said arm and cover closed.

9. An assembly according to claim 2 wherein said cover includes a circular portion having a diameter greater than the outer diameter of the end of said housing and a generally axially extending skirt portion adapted to surround the end of said housing, said skirt portion having said means defining said cam surface, recess and stop shoulder on an axially facing surface thereof.

10. An assembly according to claim 9 wherein said interengageable means includes first and second radially outwardly extending, circularly spaced apart arcuate flanges on said housing near said open end;

third and fourth radially inwardly extending arcuate flanges on said skirt portion, the angular extent of said third and fourth flanges being less than the spacings between said first and second flanges.

11. An assembly according to claim 1 and further comprising a stop pin protruding from said cover in a direction to contact said wall, said pin being angularly spaced from said sloping cam surface by an angle of between about 170° and about 190°.

* * * * *